United States Patent [19]

Meyer

[11] 4,407,208

[45] Oct. 4, 1983

[54] TEMPLATE FOR TOPSTITCHING JOINED WORKPIECE PARTS

[75] Inventor: Horst Meyer, Bad Salzuflen, Fed. Rep. of Germany

[73] Assignee: Kochs Adler AG, Bielefeld, Fed. Rep. of Germany

[21] Appl. No.: 334,824

[22] Filed: Dec. 28, 1981

[30] Foreign Application Priority Data

Apr. 1, 1981 [DE] Fed. Rep. of Germany ... 8109780[U]

[51] Int. Cl.[3] ..... D05B 21/00

[52] U.S. Cl. ..... 112/121.12; 33/23 K

[58] Field of Search ..... 112/121.12, 121.15, 112/102; 33/23 K, 174 G; 74/568

[56] References Cited

U.S. PATENT DOCUMENTS

| | | | |
|---|---|---|---|
| 3,172,379 | 3/1965 | Light | 112/121.12 |
| 3,405,670 | 10/1968 | Scholl et al. | 112/121.12 |
| 3,721,202 | 3/1973 | Dodsworth | 112/121.15 |
| 3,762,348 | 10/1973 | Junemann | 112/121.12 |
| 3,774,558 | 11/1973 | Scholl et al. | 112/121.12 |

*Primary Examiner*—H. Hampton Hunter

*Attorney, Agent, or Firm*—Max Fogiel

[57] ABSTRACT

A template for automatically topstitching joined and inverted workpiece parts on a sewing machine, in which the workpiece parts are clamped between two plates connected together by a hinge. The template is formed with guide grooves and tracks for the guiding and feeding elements of the sewing machine and provided in the area of the hinge with an opening for inserting the workpiece by a loading plate. When loading the template, positioning of the workpiece is eased by stops.

5 Claims, 4 Drawing Figures

Fig. 3
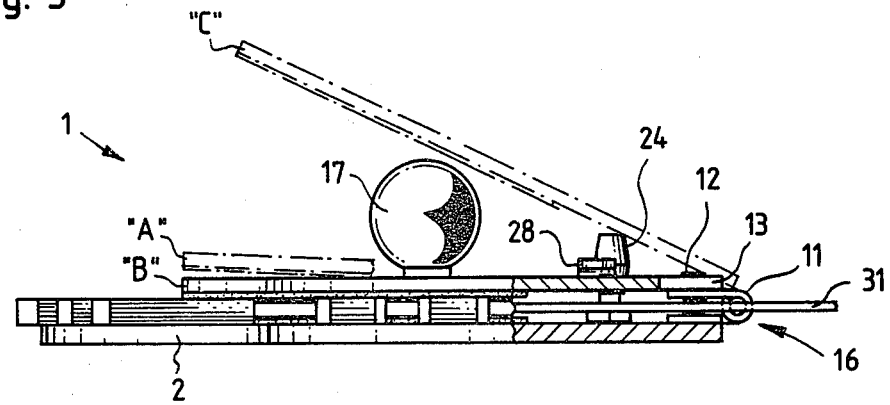
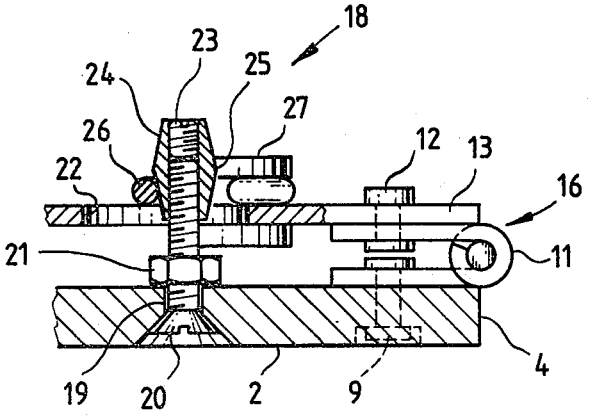
Fig. 4

TEMPLATE FOR TOPSTITCHING JOINED WORKPIECE PARTS

BACKGROUND OF THE INVENTION

The present invention relates to a template for topstitching joined workpiece parts on a sewing machine, in which the template is automatically moved by a feeding mechanism along a predetermined contour with respect to the needle.

From a product literature specification sheet (Adler 961-23-4 Template sewing unit identification No. SpP 2371-m-0979-Ti-1-3) there is known such a template which has been applied for the run- or topstitching of small parts such as cuffs, flaps and similar workpieces. For producing such articles, at first the cut plies of material are joined together at their margins by a runstitch, at which one of these plies is provided with so-called fullness. According to the above-mentioned specification sheet it is possible to simultaneously cut off excessive material as the topstitching is carried out. In the following procedure the runstitched article will be turned and pressed, for which the manually inverted part will be placed over a spreadable sword. Due to the fullness of the ply, the runstitch seam will be placed within the outside contour of the turned and stretched workpiece. In the following, the workpiece will be loaded into a press for fixing the final shape by applying pressure heat and moisture. After a short time of dwell in the press, the workpiece is ready to be topstitched, and this may be manually carried out or by the application of a template.

The described method for producing such articles additionally requires the process of workpiece press between the runstitch- and topstitch operation. Besides the high investment cost for such a press and cost for running such press, cost for the necessary style-depending swords arise.

In the German Patent DE-PS No. 20 53 635 (equivalent to U.S. Pat. No. 3,762,348) there is described a device for topstitching such small articles as cuffs or the like workpieces, at which no work step of workpiece pressing is required. The known device is equipped with a rotating worktable installed with a plurality of workpiece clamps and corresponding track elements so as to make possible an overlapped work method, at which loading, sewing and stacking is simultaneously accomplished. Although this device has a flexible construction as to process workpieces of different sizes, investment cost for style-dependent tools arise when a style change becomes necessary. Furthermore, the work for converting styles requires considerable time which gives the user the best benefit only with large quantities of workpieces to be processed.

Accordingly, it is a main object of the present invention to provide an inexpensive template which makes possible to topstitch small workpieces without the necessity of pressing the workpiece prior to topstitching.

It is a further object of the invention to provide a device for topstitching small workpieces, while incurring minimum of cost related to style changes.

Still another object of this invention is to install the template with adjustable stops to determine a firm relation of outside contour to the topstitch line of the workpiece.

Still another object of the present invention is to provide a device of the aforegoing character which is simple in construction and reliable in operation.

SUMMARY OF THE INVENTION

The objects of the present invention are achieved by the construction of a template which is formed with an opening in the hinge area of the template plates so as to load the workpiece by a loading plate. The arrangement of stops ensures a definite relation between the outside contour and the topstitch line that is produced.

The novel features which are considered as characteristic for the invention are set forth in particular in the appended claims. The invention itself, however, both as to its construction and its method of operation, together with additional objects and advantages thereof will be best understood from the following description of specific embodiment when read in connection with the accompanying drawing.

BRIEF DESCRIPTION OF THE DRAWINGS

FIG. 3 is a side elevation of the template in the direction of the arrow III in FIG. 1, showing various positions of the upper plate; and FIG. 4 is an enlarged sectional view taken on line IV—IV of FIG. 1, showing the elements clamping the plates.

DESCRIPTION OF THE PREFERRED EMBODIMENT

Figure 2:
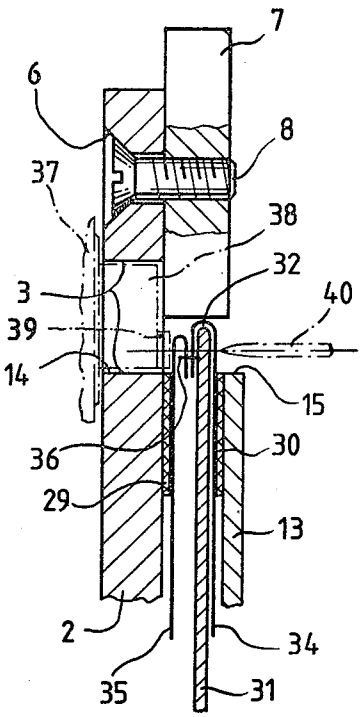
FIG. 2 is a sectional view taken along line II—II of FIG. 1, on an enlarged scale.
Figure 1:
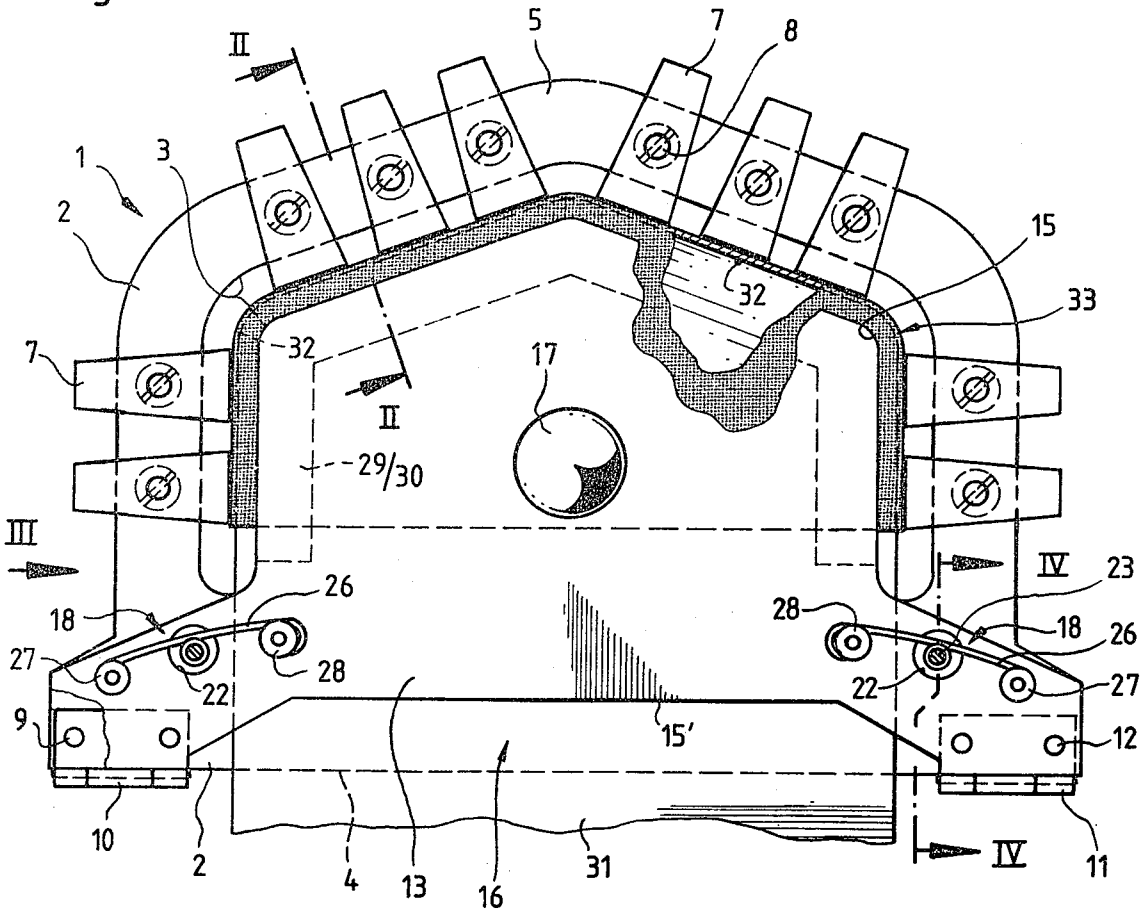
FIG. 1 is a top plan view of the template in loading position with loading plate inserted.

The template 1 (FIGS. 1 and 3) is provided with a lower plate 2 having a guide groove 3 and a straight outer edge 4. The guide groove 3 is limited by an outer margin 5 provided with bores 6 for securing stops 7 by screws 8 (FIG. 2). According to FIGS. 1, 3 and 4, to the outer edge 4 of the lower plate 2 there are secured by rivets 9, a left hinge 10 and a right hinge 11, the free ends of which carry an upper plate 13 fastened by rivets 12. The upper plate 13 is provided with an edge 15 (FIGS. 1 and 2) formed according to an inner margin 14 (FIG. 2) of the guide groove 3, and an edge 15' which is located in the lower area between the hinges 10 and 11 and offset with respect to the straight outer edge 4 of the lower plate 2. The lower plate 2 and the upper plate 13 circumscribe with the edges 4 and 15' a slot-shaped opening 16 extending between the hinges 10 and 11 (FIGS. 1, 3 and 4). Furthermore, to the upper plate 13 there is secured a ball-shaped handle 17.

In the area of the left and right hinges 10 and 11, the template 1 is provided with a clamping device 18, which is hereinafter described according to FIGS. 1 and 4. The lower plate 2 is formed with a bore 19 for receiving a screw 20 locked by a nut 21. The screw 20 projects through a circular recess 22, which is located in the upper plate 13, and carries at its free end a clamping element 24 having a lobe 25 and secured by a lock screw 23. The clamping device 18 is provided with a spring 26, which is rotatably arranged on one end, and rotatably and displaceably arranged on the other end by rivets 27 at the upper plate 13.

According to FIGS. 1 and 2, the plates 2 and 13 are provided at their marginal zones, with rubber strips 29, 30. At the sewing machine table (not shown) there is stationarily secured one end of a loading plate 31 in a horizontal or slight upwardly tilted position, whereas the free end of the plate 31 is provided with an edge 32 equidistantly formed according to the top stitch seam.

Operation of the template 1 is hereinafter described in conjunction with a flap 33 (FIGS. 1 and 2), which comprises an upper fabric layer 34 provided with fullness, and a lower fabric layer 35, sewn together by a workpiece connecting seam 36.

After manual turning, the flap 33 is placed in inverted position over the free end of the loading plate 31, at which the fabric layer 34 provided with fullness is directed to the operator, so that the workpiece connecting seam 36 of the fabric layers 34, 35 is located on the lower surface of the loading plate 31. Due to the size of the edge 32 of the loading plate 31 with respect to the connecting seam 36, the flap 33 is held on the plate 31 by friction. After the flap 33 is placed upon the loading plate 31 as described, the template 1 is slipped over the loading plate 31, where the template is held by the operator in a position, in which the upper plate 13 is in the loading position "A" according to FIG. 3. This procedure is facilitated by the shaped edges 4 and 15 circumscribing the slot-shaped opening 16. The handling of the template 1 in loading position "A" is rendered possible by the interaction of the spring 26 with the lobe 25 of the clamping element 24. The spring 26, due to the effect of the lobe 25, offers resistance to the complete closing of the upper plate 13. When slipping the template 1 over the loading plate 31 carrying the flap 35, on one hand, the stops 7 serve for the aligning procedure and, on the other hand, as edges determining the pattern's final configuration. After all stops 7 have been brought into contact with the upper fabric layer 34 of the flap 33, the template 1 will be closed. The operator imparts an additional force to the plates 2 and 13 against the tension of the springs 26, so that the springs 26 slide over the lobes, 25 and finally, the upper plate 13 assumes the clamping position "B" according to FIG. 3. When withdrawing the template 1 from the loading plate 31, the flap 33 is withdrawn from the loading plate 31 due to the friction between the rubber strips 29, 30 and the fabric layers 34, 35. The clamping devices 18 cause the plates 2, 13 to be held together with a minimum of force and simultaneously close to the template 1.

Subsequently, the template 1 loaded with the flap 33 is placed on the base plate of the sewing machine (not shown), so that the guide groove 3 of the lower plate 2 embraces a guide stud 38 arranged at the throat plate 37 (FIG. 2) of the sewing machine. The guide stud 38 is provided with a projection 39 forming a stitch hole (not specified) for the needle 40 and a support for the fabric layers 34, 35 of the flap 33 to be sewn. After operating a start push button the sewing machine is operated, and thereupon feeding means advance the template 1, which is guided by the cooperation of the guide groove 3 and the guide stud 38 of the sewing machine, without the operator's interaction. After producing the top stitch seam, the sewing machine is automatically stopped by the control elements (not shown) of the sewing machine, so that the template 1 clamping the sewn flap 33 may be removed and a second loaded template may be inserted in the aforementioned manner for a following sewing process. While sewing, the succeeding workpiece, the template 1 may be opened by the handle 17, so that the upper plate 13 is brought into a discharging position "C" (FIG. 3).

For sewing of workpieces having different thicknesses and for balancing of variations of the ratio of friction between the rubber strips 29, 30 and the fabric layers 34, 35, the required forces for workpiece loading and clamping may be compensated by adjusting the clamping elements 24 of the clamping devices 18.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A template for topstitching joined workpiece parts on a sewing machine comprising:
- stitch forming means including a needle;
- a bed plate;
- an upstanding stud formed with a stitch hole cooperating with said needle; and
- template feeding and guiding means, said template comprising further:
  - a lower plate formed with a guide groove embracing said stud;
  - an upper plate pivoted at said lower plate by hinge means;
  - clamping means for holding said two plates in pressed relation for clamping said workpiece parts interposed between said plates;
  - track means cooperating with said feeding means;
  - an opening being formed by said plates in the area of said hinge means for loading said workpiece parts by a loading plate.

2. A template as claimed in claim 1, wherein said hinge means comprises:
- a first hinge and a second hinge laterally limiting said opening, a hinge axis being located in the plane of said workpiece parts.

3. A template as claimed in claim 1, wherein said clamping means comprises:
- a lock element fastened to one of said plates and having a diamond-profiled shape; and
- spring means fastened to the other of said plates and interlocking with said lock element.

4. A template as claimed in claim 1 including
- stops adjustably fastened to one of said plates for positioning said workpiece parts loaded by said loading plate.

5. A template for topstitching joined workpiece parts on a sewing machine, comprising:
- stitch forming means including a needle;
- a bed plate;
- an upstanding stud formed with a stitch hole cooperating with said needle; and
- template feeding and guiding means;
- said template comprising further:
  - a lower plate having a frame and a clamp area separated by a guide groove embracing said stud;
  - an upper plate pivoted at said lower plate by hinge means having a hinge axis located in the plane of said workpiece parts, and a first hinge and a second hinge located in a spaced arrangement;
  - clamping means for holding said two plates in a pressed relation, and having a lock element fastened to said lower plate and having a diamond-profiled shape, and spring means fastened to said upper plate and interlocking with said lock element;
  - track means cooperating with said feeding means;
  - stops adjustably fastened to said frame of said lower plate, an opening being formed by said plates and said hinges for loading said workpiece parts by means of a loading plate.

* * * * *